US008821110B2

(12) United States Patent
Predmore et al.

(10) Patent No.: US 8,821,110 B2
(45) Date of Patent: Sep. 2, 2014

(54) SUPPORT ARRANGEMENT FOR A STEAM TURBINE LP INNER CASING

(75) Inventors: Daniel Ross Predmore, Ballston Lake, NY (US); Robert James Sherwood, Fonda, NY (US); Rajendra Gonoor, Karnataka (IN); Erik Eduardo Lopez, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 643 days.

(21) Appl. No.: 13/101,187

(22) Filed: May 5, 2011

(65) Prior Publication Data

US 2012/0282089 A1 Nov. 8, 2012

(51) Int. Cl.
*F01D 25/28* (2006.01)

(52) U.S. Cl.
USPC ..... 415/108; 415/213.1; 415/214.1; 415/220

(58) Field of Classification Search
CPC ..... F01D 25/16; F01D 25/243; F01D 25/28
USPC ..... 415/108, 220, 213.1, 214.1
See application file for complete search history.

(56) References Cited

U.S. PATENT DOCUMENTS

| | | | | |
|---|---|---|---|---|
| 3,148,282 | A * | 9/1964 | Hoffman | 290/52 |
| 3,149,470 | A * | 9/1964 | Herzog | 60/697 |
| 3,594,095 | A | 7/1971 | Trassel et al. | |
| 3,773,431 | A * | 11/1973 | Bellati et al. | 415/108 |
| 3,881,843 | A | 5/1975 | Meylan | |
| 4,413,948 | A | 11/1983 | Purr | |
| 5,779,435 | A * | 7/1998 | Lageder et al. | 415/108 |
| 8,403,628 | B2 * | 3/2013 | Koza et al. | 415/108 |

* cited by examiner

*Primary Examiner* — Ninh H Nguyen
(74) *Attorney, Agent, or Firm* — Nixon & Vanderhye P.C.

(57) ABSTRACT

A support arrangement is provided for an inner casing of a turbine having an inner casing with upper and lower sections secured together along a first interface lying substantially in a horizontal plane containing a longitudinal centerline of a turbine rotor. An outer shell substantially encloses the inner casing, and in the inner casing is supported directly on an external foundation at a mounting location below the longitudinal centerline.

35 Claims, 4 Drawing Sheets

SUPPORT ARRANGEMENT FOR A STEAM TURBINE LP INNER CASING

BACKGROUND

The present invention relates generally to steam turbine technology and, more specifically, to the manner in which steam turbine low-pressure inner casings are supported relative to the turbine machine foundation.

Conventionally, the low-pressure (LP) inner casing of a steam turbine is supported on an LP exhaust hood/outer shell structure that is, in turn, supported on the machine foundation. In some prior designs, support arms extending from the inner casing, are located vertically in substantial alignment with the longitudinal centerline of the turbine rotor assembly, coinciding with the axially-extending interfaces between both upper and lower sections of the inner LP casing, and upper and lower sections of the outer exhaust hood structure. In addition, the actual points of support are located away from the foundation proper, and inside the outer shell. See for example, U.S. Pat. Nos. 4,413,948; 3,881,843; and 3,594,095. By supporting the inner casing on the exhaust hood, away from the foundation, the inner casing is susceptible to undesirable deflections resulting from differential thermal growth in the support components due to the high temperatures inside the exhaust hood, as well as internal vacuum conditions caused by the exhaust gases exiting the hood.

BRIEF SUMMARY OF THE INVENTION

In an exemplary but nonlimiting embodiment of this invention, there is provided a support arrangement for an inner casing of a turbine comprising an inner casing having upper and lower sections secured together along a first interface lying substantially in a horizontal plane containing a longitudinal centerline of a turbine rotor; an outer shell substantially enclosing the inner casing; wherein the inner casing is supported directly on an external foundation at a mounting location below the longitudinal centerline.

In another aspect, the exemplary but nonlimiting embodiment of this invention provides a support arrangement for an inner casing of a turbine comprising an inner casing having upper and lower sections secured together along a first axially-extending interface lying substantially in a first horizontal plane containing a longitudinal centerline of a turbine rotor; an outer shell substantially enclosing the inner casing; wherein the inner casing is provided with plural, axially-spaced support arms, each having opposite free ends that are structurally supported directly on an external foundation.

In still another aspect, the exemplary but nonlimiting embodiment of this invention provides support arrangement for an inner low-pressure casing of a steam turbine comprising an inner casing having upper and lower half-sections secured together along a first interface lying substantially in a horizontal plane containing a longitudinal centerline of a turbine rotor; an outer exhaust hood comprising upper and lower exhaust hood sections substantially enclosing the inner casing and secured together along a second interface lying substantially in the first horizontal plane; wherein the inner casing is supported directly on an external foundation along a third interface lying in a second plane located below the first plane.

The invention will now be described in detail in connection with the drawings identified below.

DETAILED DESCRIPTION OF THE INVENTION

Figure 1:
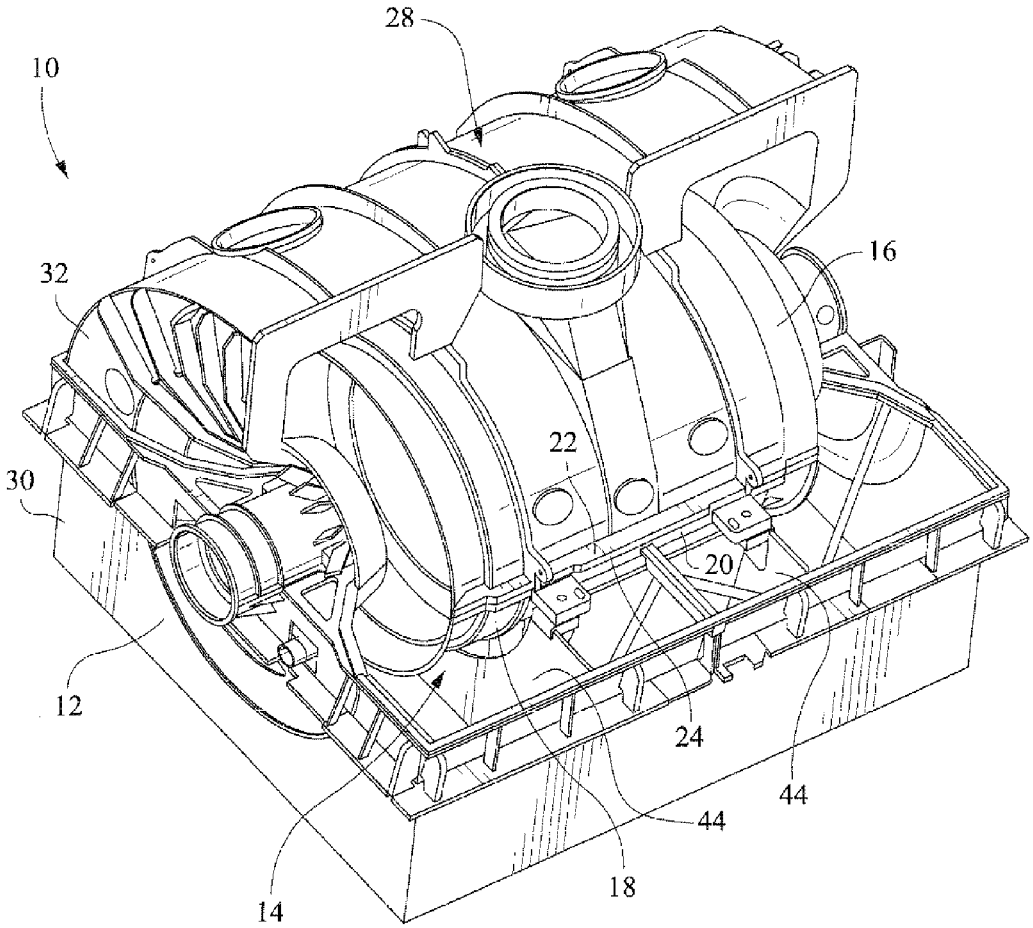
FIG. 1 is a perspective view, partially cut away, showing a conventional LP turbine with inner and outer casings.
Figure 2:
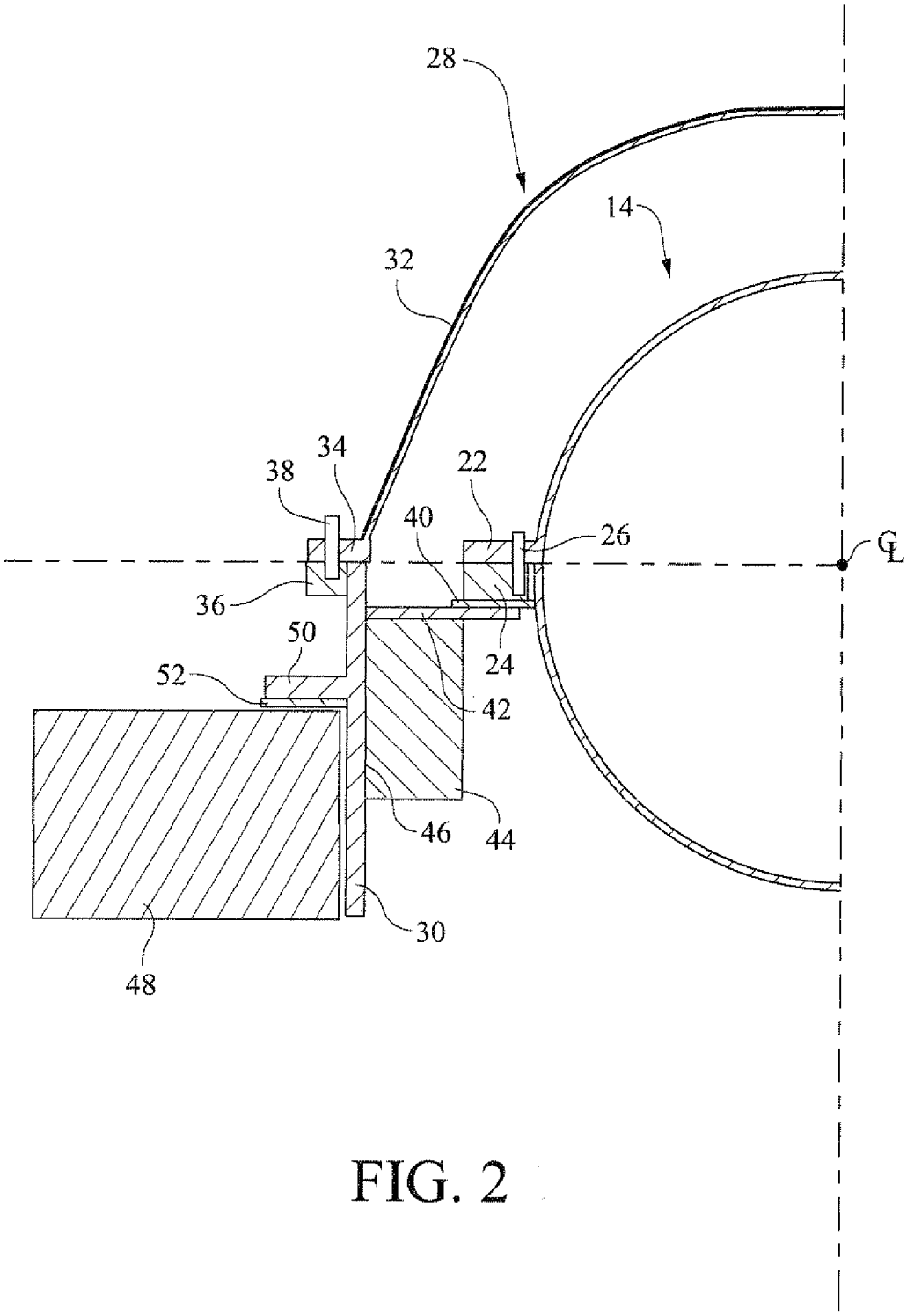
FIG. 2 is a schematic cross section showing the inner and outer LP turbine casings and the securement of the casings to the foundation in accordance with a known design.

With reference initially to FIGS. 1 and 2, a conventional low-pressure (LP) turbine section 10 is illustrated. The LP turbine section includes a rotor assembly 12 which includes a plurality of rows of buckets mounted on axially-spaced rotor wheels, the wheels alternating with rows of stationary nozzle vanes that form part of the turbine stator assembly. The invention here does not relate to the construction of the LP turbine stages and therefore, no further description of the rotor assembly or nozzle vanes is required.

The rotor assembly 12 is enclosed within an inner LP casing 14. The inner LP casing 14 is comprised of an inner casing upper half or section 16 and an inner casing lower half or section 18, joined at a horizontal interface or "split line" 20. The interface 20 lies substantially in a plane containing the turbine rotor centerline, indicated at CL in FIG. 2. Aligned, horizontally-oriented and axially-extending mounting flanges 22 and 24 are provided along the opposed interface edges of the inner casing upper half 16 and an inner casing lower half 18 (one set of flanges shown in FIG. 2), and permit attachment of the inner casing halves or sections by means of bolts 26 or other suitable fasteners.

An outer LP turbine exhaust hood or shell assembly 28 encloses the inner LP casing 14 and includes a lower exhaust hood 30 and an upper exhaust hood 32. The upper and lower exhaust hoods are secured at aligned flanges 34, 36 by bolts or other suitable fasteners 38 (FIG. 2), also substantially within the horizontal plane containing the rotor centerline CL and split line 20.

As best seen in FIG. 2, the lower mounting flange 24 of the inner casing lower section 18 rests on horizontally-oriented support plates 40, 42 which, in turn, are supported on blocks or extended ribs 44 attached to the interior surface 46 of the lower exhaust hood 30. As is well understood in the art, the horizontal plate 40 allows for some lateral shifting of the inner casing 14 relative to the support blocks or extended ribs 44.

The lower exhaust hood 30 is supported on a foundation 48 (typically an at least partially underground concrete structure) by means of another sliding interface at horizontally-oriented plates 50, 52. Typically, the inner casing 14 simply rests on the supporting structure 42, 44, with the aid of one or more hold-down bolts which allow for lateral shifting of the inner casing.

Thus, in the conventional arrangement, the inner casing 14 is supported directly on and within the outer shell (or exhaust hood) 28 which, in turn, is supported on the foundation 48.

Figure 3:
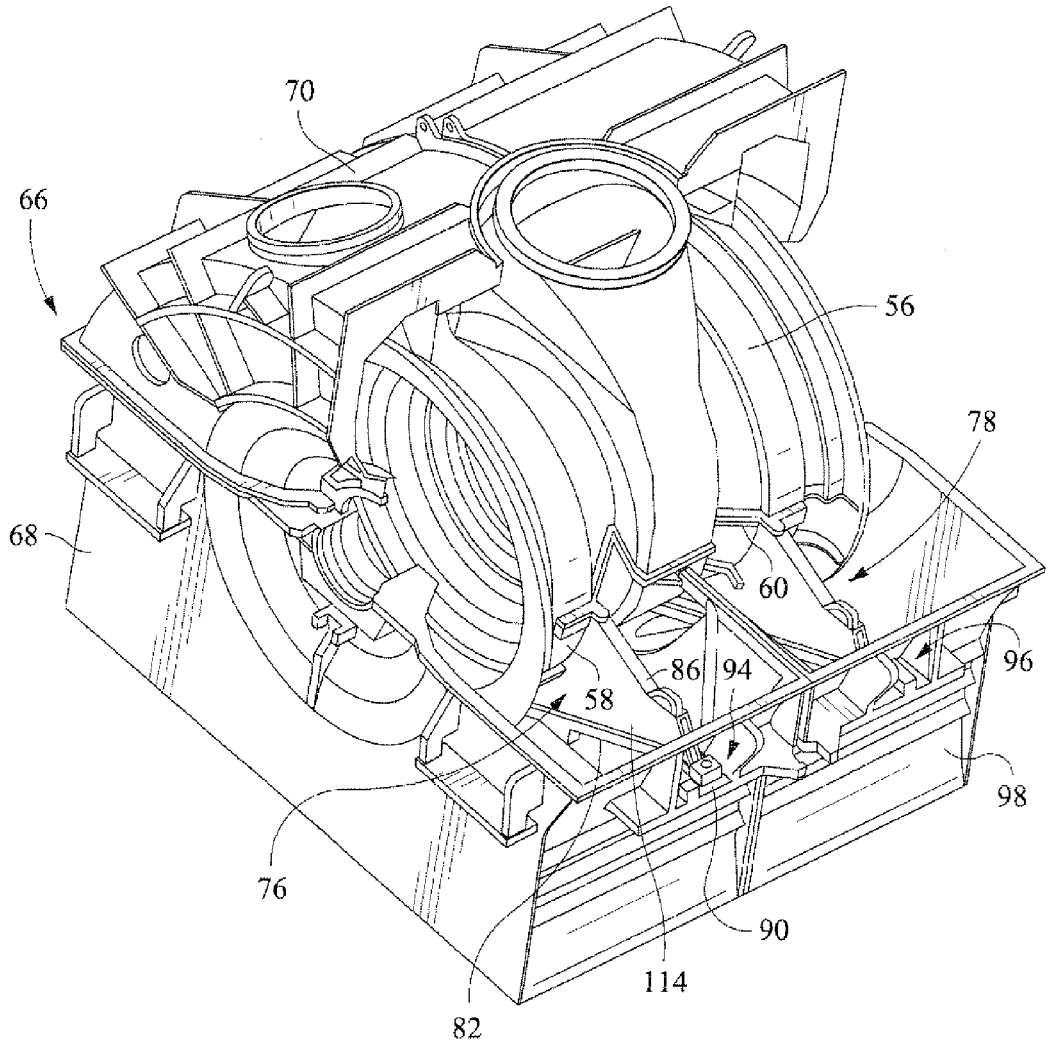
FIG. 3 is a perspective view similar to FIG. 1 but showing the inner LP casing with foundation supports in accordance with an exemplary but nonlimiting embodiment of the invention.
Figure 4:
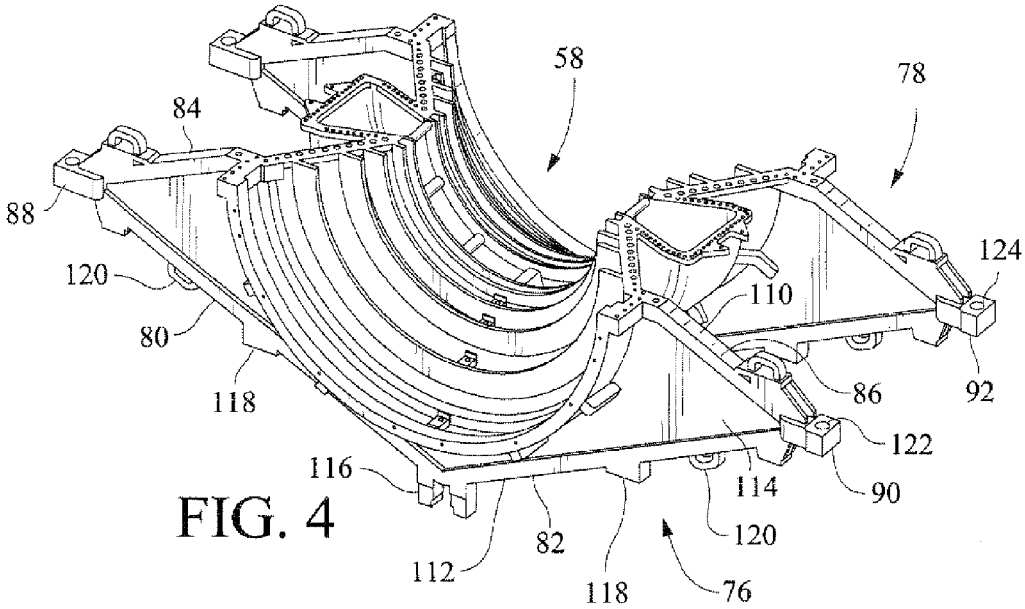
FIG. 4 is an enlarged detail showing the foundation supports incorporated within the inner LP casing lower section.
Figure 5:
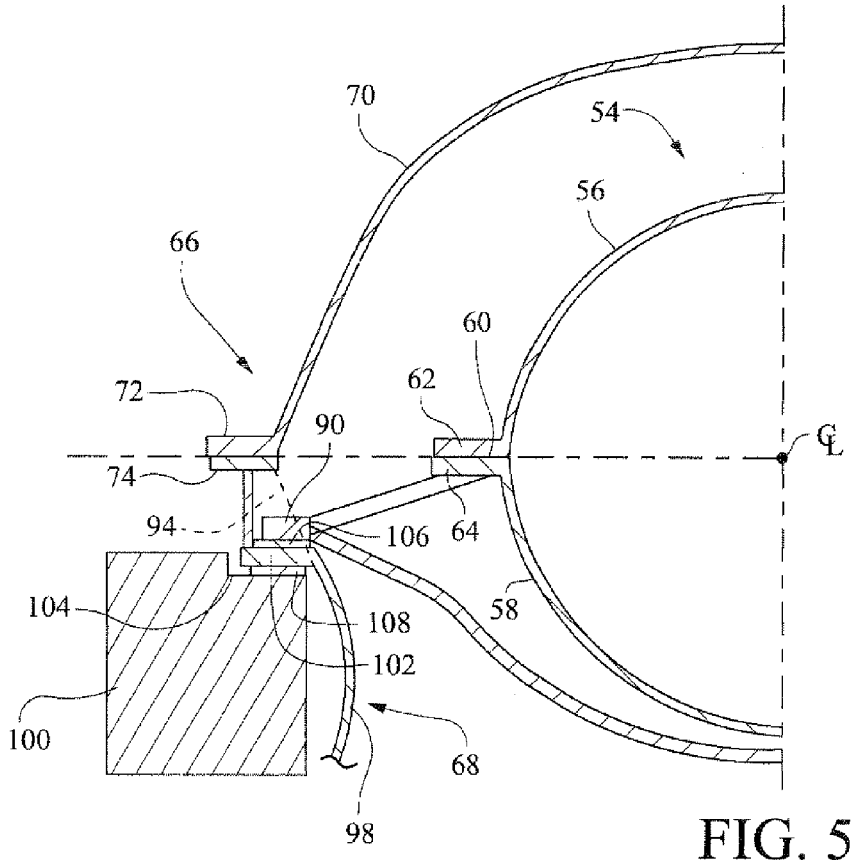
FIG. 5 is a schematic cross section similar to FIG. 2 but showing the new casing-to-foundation mounting arrangement in accordance with the exemplary but nonlimiting embodiment of the invention.

Turning now to FIGS. 3-5, an exemplary but nonlimiting embodiment of the present invention is illustrated. The LP turbine section includes a rotor assembly (not shown), similar to the rotor assembly 12 described in connection with FIGS. 1 and 2. The inner casing 54 is composed of an inner LP casing upper half or section 56 and an inner casing lower half or section 58 joined along an interface 60 lying substantially in a plane containing the longitudinal centerline CL of the rotor assembly. The inner casing upper and lower halves or sections are also provided with horizontally-oriented, axially-extending mounting flanges 62 and 64 (FIG. 5) that permit attachment of the casing upper and lower half sections by means of bolts or other suitable means (not shown).

An outer LP shell or turbine exhaust hood assembly 66 includes a lower exhaust hood 68 and an upper exhaust hood 70. The upper exhaust hood 70 and the lower exhaust hood 68 are also provided with horizontally-oriented, axially-extending mounting flanges 72, 74 that permit attachment of the outer casing assembly sections, again by means of bolts or other suitable fasteners (not shown). The lower exhaust hood 68 and the upper exhaust hood 70 are also joined in a horizontal plane containing the longitudinal centerline of the rotor assembly.

In the exemplary but nonlimiting embodiment, the inner casing lower half section 58 is formed with at least a pair of integral, axially-spaced supports 76, 78 (see especially FIG. 4) each of which encompasses substantially the entire semi-cylindrical external surface of the inner LP casing half section 58, with free ends located remote from the inner casing. More specifically, each support conforms to the shape of the casing lower half section 58 in the inner, center area of the support, with upwardly angled lower surfaces 80, 82 extending laterally away from the inner casing in a substantially V-shape, and downwardly angled upper surfaces 84, terminating at substantially horizontally-oriented support pads 88, 90. Since the support arrangement is identical on opposite sides of the inner casing/exhaust hood, only the support arrangement on one side of the inner casing 58 will be described further. Support pads 90, 92 of the axially-spaced supports 76, 78, respectively, are adapted to seat in axially-spaced pockets 94, 96 formed in the lower exhaust hood 68. The pockets 94, 96 extend beyond the remainder of the lower exhaust hood wall 98, thus permitting the support pads 90, 92 to be located directly over the foundation 100. One such pocket 94 and associated support pad 90 are more clearly shown in FIG. 5.

The support pad 90 rests on the lower horizontally-oriented base 102 of the pocket 94, which, in turn, rests on surface 104 of the foundation 100. Plates 106, 108 may be inserted between the pad 88 and the base 102, and between the base 102 and the foundation surface 104 to permit some horizontal shifting of the inner casing.

In the manner described above, the inner casing 54 is supported well below the centerline CL, and directly on the foundation 100. As a result, the thermal effects on the inner casing related to the upper and lower exhaust hoods 68, 70 and lower parts are minimized. At the same time, while there may be some vacuum effect where the upper and lower exhaust hoods 68, 70 are joined, by loading the inner casing directly on the foundation 100, any vacuum effect on the inner casing is substantially eliminated.

The integral supports 76, 78 have substantially I-beam shaped cross-sections (FIG. 4), with upper and lower flanges 110, 112 connected by a thinner web portion 114 which provide good cross-sectional strength with minimum material required. In addition, it will be appreciated that the vertical and axial locations of the support structure can be adjusted to achieve better control of diaphragm support pocket vertical deflections, and its response to different exhaust pressures and thermal conditions.

As best seen in FIG. 4, the supports 76, 78 are also formed with integral installation hardware including a jig 116 that locates the lower inner casing 58 laterally relative to the lower exhaust hood 68 but provides no vertical support. Jacking bosses 118 and lifting lugs 120 are also provided. Holes 122, 124 in the support pads 90,92 permit hold-down bolts to be employed as locators and movement limiters but it will be appreciated that, as noted above, the inner casing 54 is not rigidly and fixedly attached to the foundation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A support arrangement for an inner casing of a turbine comprising:

an inner casing having upper and lower sections secured together along a first interface lying substantially in a horizontal plane containing a longitudinal centerline of a turbine rotor;

an outer shell substantially enclosing the inner casing;

wherein the inner casing is supported directly on an external foundation at a horizontal mounting location below the longitudinal centerline.

2. The support arrangement of claim 1 wherein the upper and lower sections of the inner casing comprise substantially upper and lower half sections.

3. The support arrangement of claim 1 wherein the outer shell comprises upper and lower sections secured together along a second interface lying substantially in the horizontal plane.

4. The support arrangement of claim 3 wherein the outer shell comprises a steam turbine exhaust hood.

5. A support arrangement for an inner casing of a turbine comprising:

an inner casing having upper and lower sections secured together along a first interface lying substantially in a horizontal plane containing a longitudinal centerline of a turbine rotor;

an outer shell substantially enclosing the inner casing;

wherein the inner casing is supported directly on an external foundation at a mounting location below the longitudinal centerline;

wherein the inner casing lower half section is formed with a substantially semi-cylindrical external surface, with a pair of axially-spaced supports encompassing the substantially semi-cylindrical surface, and having horizontally-oriented support pads located at remote free ends thereof.

6. The support arrangement of claim 5 wherein the horizontally-oriented support pads are located directly over the external foundation and below said longitudinal centerline.

7. The support arrangement of claim 5 wherein the wherein the horizontally-oriented support pads are located in pockets formed in a lower section of the outer shell.

8. The support arrangement of claim 5 wherein the supports are substantially I-beam shaped in cross section.

9. The support arrangement of claim 5 wherein the upper and lower sections of the inner casing comprise substantially upper and lower half sections.

10. The support arrangement of claim 5 wherein the outer shell comprises upper and lower sections secured together along a second interface lying substantially in the horizontal plane.

11. The support arrangement of claim 10 wherein the outer shell comprises a steam turbine exhaust hood.

12. A support arrangement for an inner casing of a turbine comprising:

an inner casing having upper and lower sections secured together along a first axially-extending interface lying substantially in a first horizontal plane containing a longitudinal centerline of a turbine rotor;

an outer shell substantially enclosing the inner casing;

wherein the inner casing is provided with plural, axially-spaced support arms, each having opposite free ends that are structurally supported directly on a horizontal mounting location on an external foundation.

13. The support arrangement of claim 12 wherein the opposite free ends of each of the axially-spaced support arms are located directly over the external foundation within a second horizontal plane located below the first horizontal plane.

14. The support arrangement of claim 12 wherein the outer shell is comprised of upper and lower sections secured together along a second axially-extending interface lying substantially in the first horizontal plane.

15. The support arrangement of claim 14 wherein the outer shell comprises a steam turbine exhaust hood.

16. The support arrangement of claim 12 wherein the support arms are substantially I-beam shaped in cross section.

17. The support arrangement of claim 12 wherein said inner casing is supported so as to allow lateral shifting relative to said foundation.

18. A support arrangement for an inner casing of a turbine comprising:

an inner casing having upper and lower sections secured together along a first axially-extending interface lying substantially in a first horizontal plane containing a longitudinal centerline of a turbine rotor;

an outer shell substantially enclosing the inner casing;

wherein the inner casing is provided with plural, axially-spaced support arms, each having opposite free ends that are structurally supported directly on an external foundation;

wherein the outer shell is comprised of upper and lower sections secured together along a second axially-extending interface lying substantially in the first horizontal plane;

wherein the opposite free ends include support pads received in pockets formed in the lower section of the outer shell.

19. The support arrangement of claim 18 wherein the opposite free ends of each of the axially-spaced support arms are located directly over the external foundation within a second horizontal plane located below the first horizontal plane.

20. The support arrangement of claim 18 wherein the outer shell is comprised of upper and lower sections secured together along a second axially-extending interface lying substantially in the first horizontal plane.

21. The support arrangement of claim 20 wherein the outer shell comprises a steam turbine exhaust hood.

22. The support arrangement of claim 18 wherein the support arms are substantially I-beam shaped in cross section.

23. The support arrangement of claim 18 wherein said inner casing is supported so as to allow lateral shifting relative to said foundation.

24. A support arrangement for an inner casing of a turbine comprising:

an inner casing having upper and lower sections secured together along a first axially-extending interface lying substantially in a first horizontal plane containing a longitudinal centerline of a turbine rotor;

an outer shell substantially enclosing the inner casing;

wherein the inner casing is provided with plural, axially-spaced support arms, each having opposite free ends that are structurally supported directly on an external foundation;

wherein the lower inner casing section is formed with a substantially semi-cylindrical external surface, and wherein the at least two axially-spaced support arms encompass substantially all of the substantially semi-cylindrical surface.

25. The support arrangement of claim 24 wherein the opposite free ends of each of the axially-spaced support arms are located directly over the external foundation within a second horizontal plane located below the first horizontal plane.

26. The support arrangement of claim 24 wherein the outer shell is comprised of upper and lower sections secured together along a second axially-extending interface lying substantially in the first horizontal plane.

27. The support arrangement of claim 26 wherein the outer shell comprises a steam turbine exhaust hood.

28. The support arrangement of claim 24 wherein the support arms are substantially I-beam shaped in cross section.

29. The support arrangement of claim 24 wherein said inner casing is supported so as to allow lateral shifting relative to said foundation.

30. A support arrangement for an inner low-pressure casing of a steam turbine comprising:

an inner casing having upper and lower half-sections secured together along a first interface lying substantially in a horizontal plane containing a longitudinal centerline of a turbine rotor;

an outer exhaust hood comprising upper and lower exhaust hood sections substantially enclosing the inner casing and secured together along a second interface lying substantially in the first horizontal plane; wherein the inner casing is supported directly on a horizontal mounting location on an external foundation along a third interface lying in a second plane located below the first plane.

31. The support arrangement of claim 30 wherein the support arms are substantially I-beam shaped in cross section.

32. A support arrangement for an inner low-pressure casing of a steam turbine comprising:

an inner casing having upper and lower half-sections secured together along a first interface lying substantially in a horizontal plane containing a longitudinal centerline of a turbine rotor;

an outer exhaust hood comprising upper and lower exhaust hood sections substantially enclosing the inner casing and secured together along a second interface lying substantially in the first horizontal plane; wherein the inner casing is supported directly on an external foundation along a third interface lying in a second plane located below the first plane;

wherein the inner casing is formed with a substantially semi-cylindrical external surface, and wherein the inner casing is formed with at least two axially-spaced support arms, each engaged about the substantially semi-cylindrical surface and with remote opposite free ends provided with support pads resting directly on the external foundation.

33. The support arrangement of claim 32 wherein the support arms are substantially I-beam shaped in cross section.

34. A support arrangement for an inner low-pressure casing of a steam turbine comprising:

an inner casing having upper and lower half-sections secured together along a first interface lying substantially in a horizontal plane containing a longitudinal centerline of a turbine rotor;

an outer exhaust hood comprising upper and lower exhaust hood sections substantially enclosing the inner casing and secured together along a second interface lying substantially in the first horizontal plane;

wherein the inner casing is supported directly on an external foundation along a third interface lying in a second plane located below the first plane;

wherein the axially-spaced support arms have opposite free ends that include support pads received in pockets formed in the lower exhaust hood section.

35. The support arrangement of claim 34 wherein the support arms are substantially I-beam shaped in cross section.

* * * * *

UNITED STATES PATENT AND TRADEMARK OFFICE

CERTIFICATE OF CORRECTION

PATENT NO. : 8,821,110 B2
APPLICATION NO. : 13/101187
DATED : September 2, 2014
INVENTOR(S) : Daniel Ross Predmore et al.

It is certified that error appears in the above-identified patent and that said Letters Patent is hereby corrected as shown below:

In the Specification

At column 3, line 29, insert -- 86 -- between "upper surfaces 84," and "terminating at substantially"

Signed and Sealed this
Eighteenth Day of November, 2014

Michelle K. Lee

Michelle K. Lee
*Deputy Director of the United States Patent and Trademark Office*